United States Patent [19]

Harker

[11] Patent Number: 4,961,776

[45] Date of Patent: Oct. 9, 1990

[54] COLD HEARTH REFINING

[75] Inventor: Howard R. Harker, Malvern, Pa.

[73] Assignee: Axel Johnson Metals, Inc., Lionville, Pa.

[21] Appl. No.: 363,160

[22] Filed: Jun. 8, 1989

Related U.S. Application Data

[62] Division of Ser. No. 217,566, Jul. 11, 1988.

[51] Int. Cl.[5] ..... C22B 4/00

[52] U.S. Cl. ..... 75/10.19; 75/10.65; 266/214

[58] Field of Search ..... 75/65 RB, 93 R, 46; 266/214

[56] References Cited

U.S. PATENT DOCUMENTS 3,342,250 9/1967 Treppschuh ..... 75/10.19

4,105,438 8/1978 Sherwood ..... 75/46

*Primary Examiner*—Peter D. Rosenberg

*Attorney, Agent, or Firm*—Brumbaugh, Graves, Donohue & Raymond

[57] ABSTRACT

In the particular embodiments of the invention described in the specification, a hearth for melting and refining metal has a hearth bed with cooling pipes so that a skull of molten metal is formed and energy input devices are directionally controlled to permit the skull to form a barrier between a melting region where solid material is introduced into the hearth and a refining region where molten material is refined before being poured into a mold. In one embodiment, the barrier formed by the skull provides a dam with a narrow channel between the melting region and the refining region, and in another form, the barrier provided by the skull consists of spaced peninsulas extending from opposite sides of the hearth to provide a serpentine path between the melting region and the refining region.

5 Claims, 1 Drawing Sheet

COLD HEARTH REFINING

This application is a division of application Ser. No. 07/217,566, filed on July 11, 1988, pending.

BACKGROUND OF THE INVENTION

This invention relates to cold hearth refining of metals such as titanium alloys which must be completely free of unrefined inclusions and, more particularly, to a new and improved cold hearth arrangement which is especially adapted to prevent contamination of refined metal.

In applications wherein metals such as titanium alloys which have been refined by cold hearth refining are used in aircraft engine parts, for example, the presence of tiny amounts of unrefined inclusions in the refined ingot is severely detrimental. Since such inclusions may, for example, result in fracture and disintegration of aircraft engine parts rotating at very high speed, they should be completely avoided.

In conventional cold hearth refining of metals such as titanium alloys, a water-cooled hearth is supplied with lumps or pieces of titanium sponge or machine turnings of titanium alloy consisting of scrap from the manufacture of titanium alloy parts. This material is introduced by gravity feed at one end of a cooled, elongated hearth in a furnace in which the material is first melted and then refined by energy input from electron beam impingement or plasma torches. The refined molten material is poured from the opposite end of the hearth into a cylindrical mold where it forms a vertically disposed cylindrical ingot that is withdrawn downwardly within the mold as it solidifies.

In conventional cold hearth furnaces used for refining of titanium alloy or the like, in which compacted briquettes and large solid fragments of titanium alloy material are introduced into the melting region, unmelted portions of the alloy material may roll or float downstream from the melting region into the refining region of the hearth so as to contaminate the refined metal in the casting region. Light solids, such as chopped tubing, may also escape complete melting and float into the refining region, causing the same problem.

Heretofore, efforts have been made to separate different portions of the hearth in cold hearth refining systems by mounting physical barriers, such as dams or partitions, in the hearth. In the Hunt U.S. Pat. No. 3,343,828, for example, an elongated flow path is formed in the hearth by providing partial dividers made of graphite which extend alternately from the opposite sides of the hearth to define a serpentine path. This arrangement is not only expensive, but also is incapable of variation without complete reconstruction of the hearth. The Heimerl U.S. Pat. No. 3,748,070 discloses the formation of dams or barriers between one hearth region and another by the provision of cooling bodies at a selected location either within the hearth itself or positioned in contact with the surface of the molten material, causing the molten material to solidify and form a barrier in the immediate vicinity of the cooling body. This arrangement also requires additional hearth structure with a corresponding increase in cost and is incapable of modification without reconstructing the hearth.

Accordingly, it is an object of the present invention to provide a new and improved cold hearth refining arrangement which overcomes the above-mentioned disadvantages of the prior art.

Another object of the invention is to provide a new and improved cold hearth refining arrangement providing a separation between the melting region and the refining region of the hearth which is capable of structural modification without disassembly of the hearth.

SUMMARY OF THE INVENTION

These and other objects of the invention are attained by providing a cold hearth having an inlet end to receive material to be melted and refined and an outlet end and wherein a skull is formed by solidification of molten material, and a controlled energy input arrangement for directing energy to selected regions of the hearth in a desired manner so as to cause the formation of partial barriers of skull material located between the inlet end and the outlet end of the hearth. In one embodiment, the partial barrier of skull material comprises a dam with a narrow neck forming an outflow channel from the melting region to the refining region. In another form, the partial barrier comprises peninsulas of skull material extending in spaced relation from opposite sides of the hearth to form a labyrinth between the melting region and the refining region. In each case, the melting region is sufficiently isolated from the refining region that the transfer of unmelted material into the refining region is effectively eliminated.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
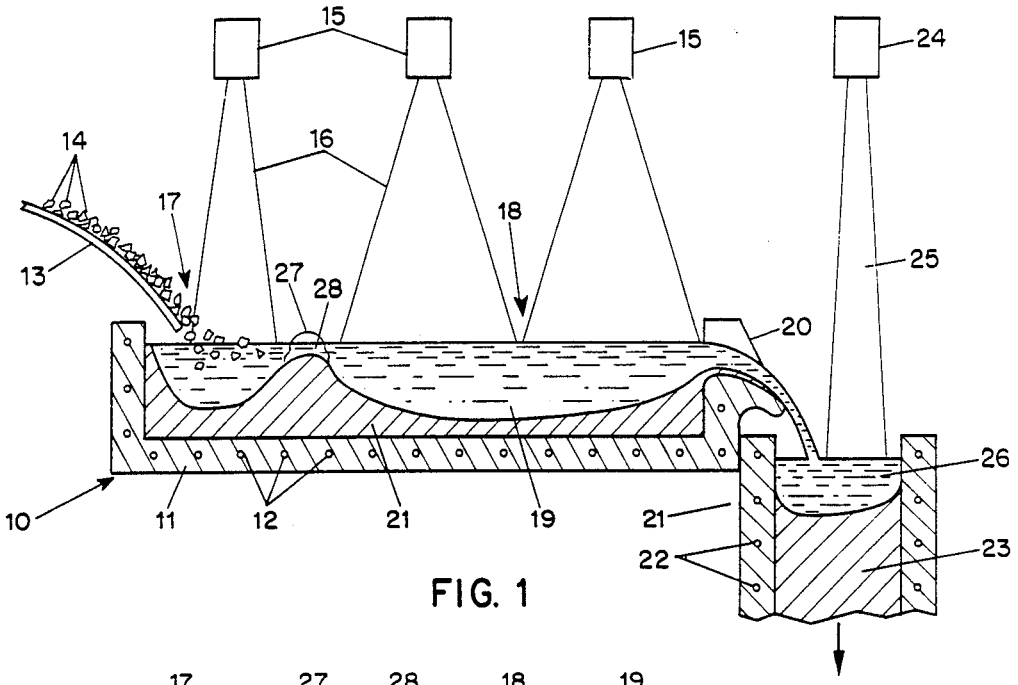
FIG. 1 is a schematic view in longitudinal section illustrating a representative cold hearth arrangement in accordance with the present invention.
Figure 2:
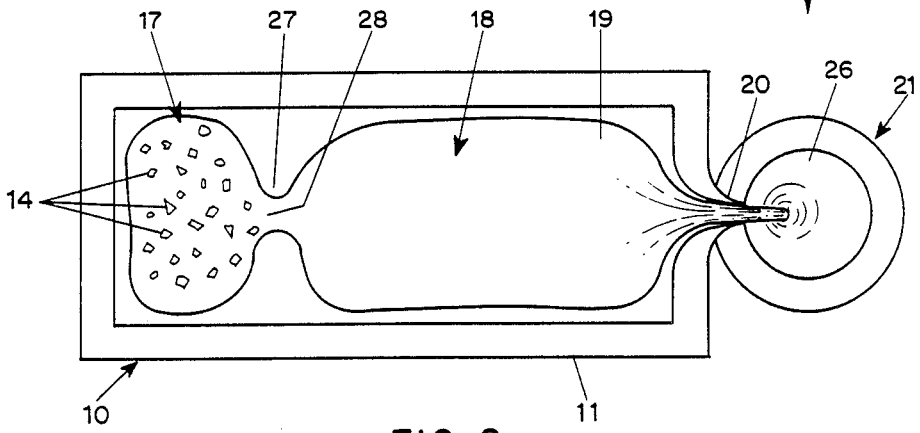
FIG. 2 is a plan view of the embodiment illustrated in FIG. 1.

In the typical embodiment of the invention shown in FIGS. 1 and 2, a hearth 10 comprises a hearth bed 11 containing cooling pipes 12 through which water or another cooling liquid may be circulated. At the inlet end of the hearth, a chute 13 directs pieces 14 of the raw material to be refined, such as titanium sponge or titanium alloy turnings, into the hearth. In the illustrated embodiment, an energy input is provided by a series of conventional directed energy input devices 15 which produce controllable patterns of energy beams 16 directed selectively to desired regions of the hearth to heat the material 14 to be melted and to refine the molten material in a desired manner. The energy input devices 15 may constitute conventional electron beam guns or conventional plasma torches which are directionally controllable. In the arrangement shown in FIG. 1, one of the energy beams 16 is concentrated on the raw material 14 in a melting region 17 of the hearth so as to melt that material and the other beams 16 are controlled to cover a refining region 18 so as to refine the molten material 19 passing through that region as it flows toward a pouring lip 20 at the other end of the hearth. Because the hearth bed 11 is cooled by liquid flowing through the pipes 12, a solid skull 21 of molten material forms on the inner surface of the hearth bed 11, protecting it from degradation by the molten material.

The refined metal 19 flows from the hearth through the pouring lip 20 into a vertical mold 21. Cooling pipes 22 are provided in the mold 21 to cool the molten material, forming an ingot 23 which is gradually moved downwardly within the mold in a conventional manner as indicated by the arrow. An energy input device 24 directs a beam of energy 25 in a controlled manner toward the surface of the molten material 26 at the top of the mold so as to control the cooling and solidification of that material into the ingot 23 in a desired manner. If electron beams are used as the energy input, the entire arrangement is, of course, contained within a sealed enclosure (not shown) and maintained at a high vacuum in the conventional manner.

As illustrated in FIGS. 1 and 2, solid material introduced into the melting region 17 of the hearth remains unmelted for a period of time. If such unmelted material passes into the refining region 18 of the mold, it may contaminate the molten material 19 which will then carry contaminants with it as it flows through the pouring lip 20 into the mold 21. In order to prevent such contamination in accordance with the invention, the directional pattern of energy input, such as the orientation of plasma torches, or the direction of beams 16 produced by the energy input devices 15 of FIG. 1 is controlled so as to avoid heating of selected portions of the alloy material in the hearth, permitting growth of the skull 21 to form a dam extending above the surface of the molten material from each side of the hearth toward the center. The energy input pattern is controlled to provide a narrow and shallow passage 28 of molten material, permitting controlled flow of the material from the melting region 17 to the refining region 18. In this way, the introduction of unmelted material into the refining region and corresponding contamination of the material in the ingot 23 is effectively prevented.

Figure 3:
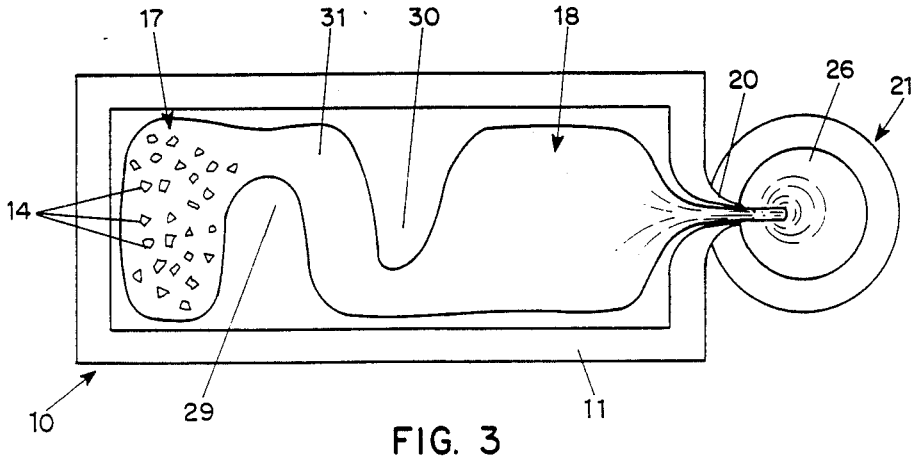
FIG. 3 is a plan view showing another embodiment of the invention.

In the embodiment shown in FIG. 3, the barrier arrangement between the melting region 17 and the refining region 18 of the hearth is provided by controlling the energy input pattern so as to permit the skull material to form two adjacent spaced peninsulas 29 and 30 extending from each side of the hearth toward the opposite side. This leaves a serpentine channel 31 for the flow of molten material between the melting region 17 and the refining region 18, permitting extended exposure of any unmelted material to the energy input from electron beams or plasma torches so as to assure complete melting of that material before it reaches the refining region 18.

With the arrangements shown in FIGS. 1–3 in accordance with the present invention, metals such as titanium alloy can be refined in a cold hearth furnace without concern over possible inclusions which might result from unmelted material passing into the refining region and then being carried into the ingot so as to contaminate the resulting material. It will be understood, of course, that the invention is not restricted to the use of a single hearth and may be used in cold hearth refining systems having two or more hearths and, if desired, the skull barriers formed in accordance with the present invention may be provided in only the first hearth or in two or more successive hearths.

Although the invention has been described herein with reference to specific embodiments, many modifications and variations therein will readily occur to those skilled in the art. Accordingly, all such variations and modifications are included within the intended scope of the invention.

I claim:

1. A method for melting and refining material in a cold hearth system comprising cooling a hearth in which material is to be melted and refined, supplying solid raw material which is to be melted and refined in a melting region of the hearth, applying energy to the region of the hearth to which the solid material is supplied to produce molten material, flowing molten material from the melting region toward a refining region of the hearth spaced from the melting region, applying energy to the refining region of the hearth to refine molten material therein, and selectively controlling the application of energy to the hearth so as to cause formation of a partial barrier of skull material between the melting region and the refining region to prevent unmelted raw material from being transported from the melting region to the refining region.

2. A method according to claim 1 wherein the application of energy is controlled to provide a dam extending substantially across the hearth, providing a restricted passage for flow of molten material from the melting region to the refining region.

3. A method according to claim 1 wherein the application of energy is controlled to produce spaced projections of skull material from opposite sides of the hearth, providing a serpentine flow path between the melting region and the refining region.

4. A method according to claim 1 wherein the energy is applied to the material in the hearth by electron beam gun means.

5. A method according to claim 1 wherein the energy is applied to the material in the hearth by plasma torch means.

* * * * *